US011742584B2

(12) United States Patent
Manninen

(10) Patent No.: US 11,742,584 B2
(45) Date of Patent: Aug. 29, 2023

(54) RADIATING COAXIAL CABLE

(71) Applicant: Prysmian S.p.A., Milan (IT)

(72) Inventor: Mika Manninen, Oulu (FI)

(73) Assignee: Prysmian S.p.A., Milan (IT)

( * ) Notice: Subject to any disclaimer, the term of this patent is extended or adjusted under 35 U.S.C. 154(b) by 33 days.

(21) Appl. No.: 17/104,454

(22) Filed: Nov. 25, 2020

(65) Prior Publication Data

US 2021/0159603 A1 May 27, 2021

(30) Foreign Application Priority Data

Nov. 27, 2019 (IT) ..... 102019000022329

(51) Int. Cl.
*H01P 3/06* (2006.01)
*H01Q 13/20* (2006.01)
*H01Q 1/52* (2006.01)

(52) U.S. Cl.
CPC ..... *H01Q 13/203* (2013.01); *H01P 3/06* (2013.01); *H01Q 1/526* (2013.01)

(58) Field of Classification Search
CPC ..... H01Q 13/203; H01Q 1/526; H01Q 1/52; H01P 3/06; H01P 11/005
See application file for complete search history.

(56) References Cited

U.S. PATENT DOCUMENTS 4,280,225 A * 7/1981 Willis ..... H01Q 1/40 174/120 SR
5,042,904 A * 8/1991 Story ..... G02B 6/4495 174/23 R
6,353,177 B1 * 3/2002 Young ..... H01B 9/008 57/213
8,623,787 B2 * 1/2014 Willen ..... H01B 12/14 505/431

(Continued)

FOREIGN PATENT DOCUMENTS

CN 203038724 * 7/2013
CN 2409585 Y * 12/2020
EP 3584887 A1 * 12/2019

(Continued)

OTHER PUBLICATIONS

Radio Frequency Systems, "Installation Guideline, Radiaflex Cables," Edition J, Jan. 1, 2012, retrieved at http://products.rfsworld.com//userfiles/instruction_sheets/radiaflex_installation_guideline_edition_i_2.pdf, 47 pages.

*Primary Examiner* — Ab Salam Alkassim, Jr.
*Assistant Examiner* — Anh N Ho
(74) *Attorney, Agent, or Firm* — Slater Matsil, LLP

(57) ABSTRACT

Disclosed is a radiating coaxial cable comprising an inner conductor, an insulating layer surrounding the inner conductor, a conductive shield surrounding the insulating layer and a jacket surrounding the shield. The conductive shield comprises a radiating longitudinal shield portion with radi- (Continued)

ating apertures and a non-radiating longitudinal shield portion with no radiating apertures. The jacket comprises a first jacket portion facing the radiating shield portion and a second jacket portion facing the non-radiating shield portion. The first jacket portion is thicker than the second jacket portion. This way, the cable is more protected against detrimental effects of metal objects brought near to or in contact with its radiating side.

7 Claims, 5 Drawing Sheets

(56) References Cited

U.S. PATENT DOCUMENTS

2017/0059150 A1 3/2017 Wenger

FOREIGN PATENT DOCUMENTS

| | | | | |
|---|---|---|---|---|
| JP | S52007540 | U | | 1/1977 |
| JP | S62163810 | | * | 10/1987 |
| JP | S62163810 | U | * | 10/1987 |
| JP | 2003229716 | A | | 8/2003 |
| JP | 2015177272 | A | | 10/2015 |
| JP | 2016213546 | | * | 12/2016 |
| KR | 20110065796 | | * | 6/2011 |
| KR | 20110065796 | A | * | 6/2011 |

* cited by examiner

RADIATING COAXIAL CABLE

CROSS-REFERENCE TO RELATED APPLICATIONS

This application claims the benefit of Italian Patent Application No. 102019000022329 filed on Nov. 27, 2019, which application is hereby incorporated herein by reference.

TECHNICAL FIELD

The present disclosure relates to the field of coaxial cables. In particular, the present disclosure relates to a radiating coaxial cable and to a process for manufacturing a radiating coaxial cable.

BACKGROUND

As known, a radiating coaxial cable (also known as "leaky coaxial cable") is a coaxial cable configured to emit and receive radio waves at a specific radiofrequency or in a specific radiofrequency range, so as to function as an extended antenna. Radiating coaxial cables are typically used to provide uniform radiofrequency coverage (for example, mobile coverage) to extended and narrow indoor environments, such as tunnels (metro, railway and road tunnels), buildings (e.g. office corridors, shopping centers or parking garages), mines or ships.

Known coaxial cables comprise an inner conductor surrounded by an insulating layer, a tubular conductive shield (a.k.a. "outer conductor") and a jacket, which is typically the outermost cable layer. In radiating coaxial cables, a plurality of apertures (like slots or holes) is punched through in the shield to allow the radio waves to leak into and out of the cable along its length. The apertures can be aligned longitudinally along the cable shield. A single straight line of radiating apertures may be provided in the cable shield, so that the coaxial cable has a single radiating side. Alternatively, two or more diametrically opposed straight lines of radiating apertures may be provided in the cable shield, so that the coaxial cable has two opposite radiating sides.

The performance of a radiating coaxial cable is measured in terms of several parameters, including return loss, attenuation and coupling loss. In particular, return loss is the loss of power in the signal returned/reflected by discontinuities in the cable. Most applications of radiating coaxial cables require that the return loss (measured on a 100 m length of straight cable) does not exceed a maximum threshold of −18 dB. A higher return loss may interfere with the proper functioning of the transmitter or even damage it.

A metal object placed near a radiating coaxial cable on a radiating side thereof may affect its performance in terms of return loss and attenuation. A metal object near the cable on its radiating side indeed acts as a resonating element which reflects the radiofrequency signal and ultimately increases its return loss and attenuation.

Installation of radiating coaxial cables in tunnels or buildings typically makes use of suitable clamps configured to fix the cable to a supporting surface, e.g. a wall or ceiling. Such clamps are typically made of plastic, in order not to affect the cable performance as discussed above. A clamp comprises a ring portion whose diameter substantially matches the outer diameter of the radiating coaxial cable, so as to accommodate the cable and firmly hold it. The coaxial cable is typically housed in the ring portion of the clamp with its radiating side pointing away from the supporting surface.

In order to securely fix a length of radiating coaxial cable to a supporting surface, a plurality of plastic clamps evenly distributed along the cable length shall be used. Secure fixing is typically obtained with a clamp installation spacing of 1-3 meters.

In some conditions, however, plastic clamps alone cannot guarantee a secure installation of radiating coaxial cables.

"Installation Guidelines RADIAFLEX® Cables, Edition J" (2012), retrieved at: http://products.rfsworld.com//user-files/instruction_sheets/radiaflex_installation_guideline_edition_j_2.pdf, discloses use of fire-resistant clamps developed for situations which require the cable to remain functional as long as possible in the event of fire. In this case, indeed, the cable should not become detached from the wall or ceiling and in doing so perhaps also block an escape route. Such fire-resistant clamps are made of stainless steel and should be used in addition to the plastic clamps. The recommended installation spacing for these fire-resistant clamps is approximately 8-10 meters. Similarly to the plastic clamps, also the fire-resistant clamps comprise a ring portion whose diameter substantially matches the outer diameter of the radiating coaxial cable, so as to accommodate the cable and firmly hold it.

SUMMARY

In one embodiment, a radiating coaxial cable comprises an inner conductor, an insulating layer surrounding and directly contacting the inner conductor, a conductive shield surrounding the insulating layer and comprising a radiating longitudinal shield portion and a non-radiating longitudinal shield portion. A plurality of radiating apertures is disposed in the radiating longitudinal shield portion, while the non-radiating longitudinal shield portion is free from any radiating apertures. A jacket surrounds the conductive shield and comprises a first jacket portion facing the radiating shield portion and a second jacket portion facing the non-radiating shield portion, where the first jacket portion is thicker than the second jacket portion.

In one embodiment, a process for manufacturing a radiating coaxial cable includes forming an insulating layer surrounding and directly contacting an inner conductor and forming a conductive shield surrounding the insulating layer and comprising a radiating longitudinal shield portion and a non-radiating longitudinal shield portion. A plurality of radiating apertures is formed in the radiating longitudinal shield portion, the non-radiating longitudinal shield Portion being free from any radiating apertures. A jacket surrounding the conductive shield is formed. The jacket comprises a first jacket portion facing the radiating shield portion and a second jacket portion facing the non-radiating shield portion, where the first jacket portion is thicker than the second jacket portion.

BRIEF DESCRIPTION OF THE DRAWINGS

The present disclosure will become fully clear after reading the following detailed description, given by way of example and not of limitation, with reference to the attached drawings wherein.

DETAILED DESCRIPTION OF ILLUSTRATIVE EMBODIMENTS

Figure 1:
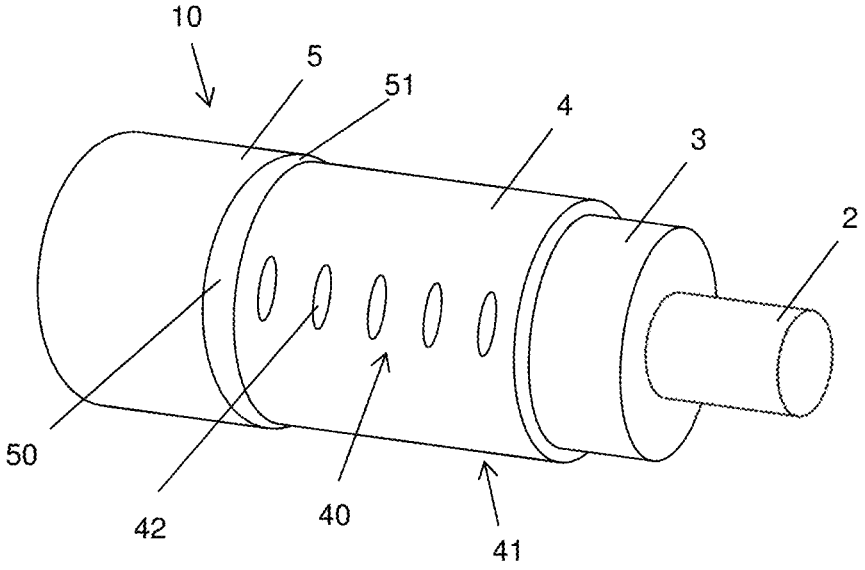
FIG. 1 schematically shows a lateral view of a radiating coaxial cable according to a first embodiment of the present disclosure.

The Applicant has noticed that the fire-resistant clamps are metal objects which during installation surround and are in contact with the jacket of the radiating coaxial cable. Hence, they may act as resonating elements increasing the cable return loss or attenuation as discussed above.

In general, the Applicant has tackled the challenge of providing a radiating coaxial cable which is less prone to the detrimental effects induced by metal objects, such as fire-resistant clamps, brought into contact with or near to its radiating side(s).

Embodiments of the present disclosure overcome these and other challenges by a radiating coaxial cable whose conductive shield comprises at least one radiating longitudinal portion wherein a plurality of radiating apertures is present and at least one non-radiating longitudinal portion with no apertures. A jacket surrounds the conductive shield. The jacket has a varying thickness, in particular the jacket portion facing the radiating portion of the conductive shield is thicker than the jacket portion facing the non-radiating portion of the conductive shield.

The greater thickness of the jacket portion facing the radiating shield portion advantageously increases the distance from the radiating shield portion of any object external to the cable, e.g. a metal object such as a metal clamp, which is brought near or into contact with the outer surface of the radiating coaxial cable on its radiating side.

The Applicant has indeed made some tests and found that, when a metal object is brought into contact with a coaxial cable on its radiating side, its return loss exhibits peaks at a number of resonance frequencies and, at the peaks, the return loss value (measured on a 100 m length of straight cable) is higher than the maximum threshold −18 dB. If, however, the metal object is brought at a certain distance from the coaxial cable, the return loss decreases. The Applicant has observed that a distance of 2-12 mm is sufficient to bring the return loss below the maximum threshold −18 dB over the whole operative frequency range of the coaxial cable.

By performing these tests, the Applicant has realized that, since the outermost jacket of a radiating coaxial cable typically has a thickness typically ranging from 1 mm to 6 mm, the above return loss reduction (under −18 dB) may be achieved by increasing the thickness of the jacket portion on the radiating side of the cable, namely the jacket portion facing the apertures in the cable shield.

Hence, when the cable is installed by using (also) metal clamps which, in order to firmly hold the cable, are shaped so as to surround and be in contact with the jacket of the radiating coaxial cable, the disturbing effect of the metal clamps in terms of return loss and/or attenuation is advantageously reduced, since the metal clamps are kept at an increased distance from the radiating portion of the shield.

The installation spacing of fire-resistant metal clamps may then be reduced from 8-10 m to 2-3 meters, thereby allowing to avoid use of plastic clamps. Use of a single type of clamps (metal clamps) advantageously results in easier installation of the cable, reduced installation costs and improved safety in case of fire event.

Therefore, according to a first aspect, the present disclosure provides for a radiating coaxial cable comprising: an inner conductor; an insulating layer surrounding and directly contacting the inner conductor; a conductive shield surrounding the insulating layer and comprising at least one radiating longitudinal shield portion wherein a plurality of radiating apertures is present, and at least one non-radiating longitudinal shield portion free from radiating apertures; and a jacket surrounding the conductive shield, and comprising at least one first jacket portion facing the radiating shield portion and at least one second jacket portion facing the non-radiating shield portion, wherein the first jacket portion is thicker than the second jacket portion.

The radiating coaxial cable according to the present disclosure has a jacket with a cross section having a substantially circular inner contour and a substantially elliptical outer contour.

In an embodiment, the cross section of the jacket may have an outer contour concentric with the conductive shield. In an alternative embodiment, the cross section of the jacket may have an outer contour eccentric relative to the conductive shield.

In an embodiment of the disclosure, the first jacket portion comprises a cavity longitudinally extending along at least one length of the radiating coaxial cable. Such cavity can be empty or at least partially filled with a filling material. The filling material can be solid or foamed material, for example a foamed polymer which can be the same of the jacket or different.

In an embodiment, the cavity, when empty, may house optical fibers. The optical fibers may be provided during the manufacturing of the cable or inserted in the cable cavity after cable deployment, for example by blowing.

In an embodiment, the thickness of the first jacket portion ranges from 2 mm to 20 mm. In an embodiment, the thickness of the second jacket portion ranges from 1 mm to 6 mm.

In an embodiment, a mica tape can be interposed between the conductive shield and the insulating layer, otherwise directly contacting one another.

In an embodiment, a mica tape or other fire barrier, a fiber tape, a PET (polyethylene terephthalate) tape or a paper tape or foil may be interposed between the jacket and the conductive shield, otherwise directly contacting one another.

According to a second aspect, the present disclosure relates to a process for manufacturing a radiating coaxial cable, said process comprising: providing an inner conductor; providing an insulating layer surrounding and directly contacting the inner conductor; providing a conductive shield surrounding the insulating layer and comprising at least one radiating longitudinal shield portion wherein a plurality of radiating apertures is present, and at least one non-radiating longitudinal shield portion free from radiating apertures; and providing a jacket surrounding the conductive shield and comprising at least one first jacket portion facing the radiating shield portion and at least one second jacket portion facing the non-radiating shield portion, wherein the one first jacket portion is thicker than the second jacket portion.

In the present description and claims as "thickness" of the cable jacket it is meant the distance between the two points that, in a transversal plane of the cable, result from intersection between a ray, originating in the center of the conductive shield, and the inner surface and outer surface of the cable jacket.

For the purpose of the present description and of the appended claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

The present disclosure, in at least one of the aforementioned aspects, can be implemented according to one or more of the following embodiments, optionally combined together.

For the purpose of the present description and of the appended claims, the words "a" or "an" should be read to include one or at least one and the singular also includes the plural unless it is obvious that it is meant otherwise. This is done merely for convenience and to give a general sense of the disclosure.

The reference numbers used in all the Figures shall be the same for equivalent cables and cable portions.

FIG. 1 shows a lateral view of a radiating coaxial cable 10 according to a first embodiment of the present disclosure.

The radiating coaxial cable 10 comprises an inner conductor 2 surrounded by an insulating layer 3, a tubular conductive shield 4 and a jacket 5. The jacket 5 may be the outermost layer of the radiating coaxial cable 10. The radiating coaxial cable 10 may also comprise other layers (e.g. a fire barrier or wrapping tape interposed between shield 4 and jacket 5 and/or interposed between insulating layer 3 and shield 4), which are not shown in the Figures and will not be described herein below.

The inner conductor 2 may be hollow or solid. In case of a hollow conductor, it can be in form of a corrugated welded tube. The inner conductor 2 is made of an electrically conductive metal such as copper, aluminum or composite thereof. The inner conductor 2 can have an outer diameter comprised between 1 mm and 25 mm.

The insulating layer 3 can be made of polyethylene, optionally foamed, or other suitable electrically insulating material. The insulating layer 3 can have an outer diameter comprised between 5 mm and 55 mm and a thickness comprised between 1 mm and 20 mm.

The conductive shield 4 is made of an electrically conductive metal such as copper, aluminum or composite thereof. The shield 4 may be either smooth or corrugated. The shield 4 may be either welded or folded. The shield 4 can have an outer diameter comprised between 5 mm and 60 mm and a thickness comprised between 0.03 mm and 4 mm (including corrugations, if present).

According to the first embodiment, the shield 4 comprises one radiating portion 40 longitudinally extending along the cable length. The radiating portion 40 of the shield 4 has a plurality of radiating apertures 42 punched through the shield thickness to allow the radio waves to leak into and out of the cable 10, which accordingly acts as an antenna. The remainder of the shield 4, which has no radiating apertures, will be termed herein after "non-radiating portion" of the shield 4 and is indicated by reference numeral 41.

The jacket 5 is made of a polymeric material, such as polyethylene. Optionally, the jacket 5 may have fire retardant properties. For example, the jacket 5 may be made of a halogen free fire retardant thermoplastic material.

The jacket 5 has a non-uniform thickness. In particular, the first jacket portion 50 facing the radiating portion 40 of the shield 4 is thicker than the remainder of the jacket 5, namely, the second jacket portion 51, which faces the non-radiating shield portion 41.

Figure 2A:
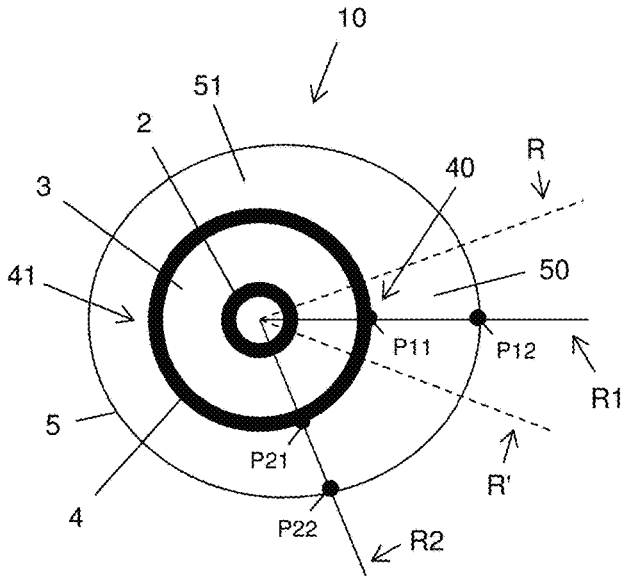
FIGS. 2*a* and 2*b* schematically show the radiating coaxial cable according to the first embodiment of the present disclosure and a variant thereof.

FIG. 2*a* shows a cross-section view of the radiating coaxial cable 10 of FIG. 1.

As depicted in FIG. 2*a*, the first jacket portion 50 facing the radiating portion 40 of the shield 4 is the jacket portion enclosed between two rays R and R' originating in the center of the shield 4 and intersecting the opposite edges of the apertures 42 in the radiating portion 40 of the shield 4. As "thicker" it is meant that at least one thickness of the first jacket portion 50 is greater than all the thicknesses of the second jacket portion 51.

As depicted in FIG. 2*a*, a first ray R1, originating in the center of the shield 4, crosses the first jacket portion 50 and defines two points P11 and P12 at the intersection with, respectively, inner surface and outer surface of the jacket 5. A second ray R2, originating in the center of the shield 4, instead crosses the second jacket portion 51 at a certain angular position, thereby defining two points P21 and P22 at the intersection with, respectively, inner surface and outer surface of the jacket 5. According to the present invention, the distance P11-P12 is greater than the distance P21-P22 for at least one ray R1 crossing the first jacket portion 50 and for every ray R2 crossing the second jacket portion 51 at any angular position.

While the thickness of the second jacket portion 51 may range from 1 mm to 6 mm, the thickness of the first jacket portion 50 may instead range from 2 mm to 20 mm, for example from 5 mm to 15 mm.

For example, the jacket 5 may have a cross section with a substantially circular inner contour and an oval or substantially elliptical outer contour, as depicted in FIG. 2*a*. According to the first embodiment, the jacket 5 is shaped so that the center of its cross section outer contour is at an intermediate position between the center of the shield 4 and the radiating portion 40 of the shield 4 (eccentric arrangement). Such an eccentric arrangement results in the first jacket portion 50 being thicker than the second jacket portion 51.

Other shapes of the jacket cross-section could be envisaged, provided the first jacket portion 50 facing the radiating portion 40 of the shield 4 is thicker than the second jacket portion 51 which faces the non-radiating portion 41 of the shield 4.

Figure 2B:
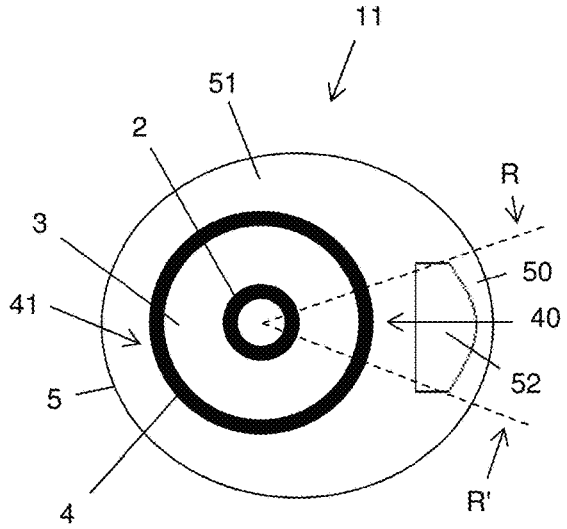

FIG. 2*b* shows a cross-sectional view of a radiating coaxial cable 11 according to a variant of the first embodiment. The radiating coaxial cable 11 is identical to radiating coaxial cable 10 except in that the first jacket portion 50 facing the radiating portion 40 of the shield 4 comprises a cavity 52 longitudinally extending along at least of length of the radiating coaxial cable 11.

The shape and size of the cross section of the cavity 52 may be chosen, on the one hand, so as to maximize protection of the radiating portion 40 against interference of metal objects placed near to or in contact with the radiating coaxial cable 11 and, on the other hand, to preserve the mechanical solidity of the cable 11 by preventing the first jacket portion 50 from collapsing when the radiating coaxial cable 11 is bent or subjected to mechanical stresses. The shape and size of the cavity 52 as depicted in FIG. 2*b* is purely exemplary.

The cavity 52 may be either empty (namely, filled with air), or at least partially filled with an optionally foamed material improving mechanical solidity of the cable 11 and enhancing protection of the radiating portion 40 against interference of metal objects placed near to or in contact with the radiating side of coaxial cable 11. For example, a foam could be used to fill the cavity 52.

The material for at least partially filling the cavity 52 can be, for example, polyethylene or a low-smoke zero-halogen (LSZH) compound comprising, for example, ethylene vinyl acetate (EVA). This material can be foamed by techniques familiar to the skilled person, for example by adding a foaming agent to polymer, then extruded. Alternatively, a gas like nitrogen or carbon dioxide or other gas is mixed with granulates of the filling material to release a pressure out of the crosshead of the extruder, which causes foaming of the filling material.

If the cavity 52 is empty, it may house one or more optical fibers (not depicted in FIG. 2*b*).

As described above, according to the first embodiment the shield 4 is curved at its radiating portion 40 and the jacket 5 is shaped so as to be eccentric relative to the shield 4. According to a second embodiment, the apertures 42 impart to the shield 4 a substantially flat shape of its radiating portion 40, so that a thicker first jacket portion 50 may be obtained by either a concentric arrangement or an eccentric arrangement of the jacket 5.

Figure 3A:
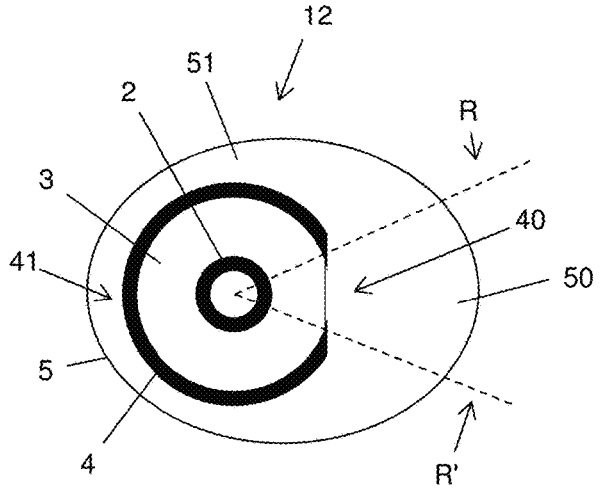
FIGS. 3*a* and 3*b* schematically show a radiating coaxial cable according to a second embodiment of the present disclosure and a variant thereof.

FIG. 3*a* shows a cross-sectional view of a radiating coaxial cable 12 according to a second embodiment of the present invention. According to the second embodiment, the presence of the radiating apertures 42 imparts the radiating portion 40 of the shield 4 with a flat appearance in cross-section.

For example, the jacket 5 may have a cross section with a substantially circular inner contour (excepting for one or more flat portions contacting the aperture/s 42 of radiating portion 40 of the shield 4) and an oval or substantially elliptical outer contour, as depicted in FIG. 3*a*.

As shown in FIG. 3*a*, the jacket 5 may be shaped so that the center of its cross section outer contour is at an intermediate position between the center of the shield 4 and the radiating portion 40 of the shield 4 (eccentric arrangement). This way, an outer size of the jacket 5 (and hence of the whole cable 12) substantially equal to that of the radiating coaxial cable 10 according to the first embodiment results in a still further thicker first jacket portion 50 facing the radiating portion 40 of the shield 4, due to the flat shape of the radiating portion 40. According to the second embodiment, the radiating portion 40 of the shield 4 is therefore even more protected against interference of metal objects placed near to or in contact with the radiating side of the coaxial cable 12.

Alternatively, the jacket 5 could be shaped so that the center of its cross section outer contour is substantially coincident with the center of the shield 4 (concentric arrangement, not shown in the drawings). Even if the arrangement is concentric, the first jacket portion 50 results to be thicker than the second jacket portion 51, at least because of the flat shape of the radiating portion 40 of the shield 4.

Other shapes of the jacket cross-section could be envisaged, provided the first jacket portion 50 facing the radiating portion 40 of the shield 4 is thicker than the second jacket portion 51 facing the non-radiating portion 41 of the shield 4.

Figure 3B:
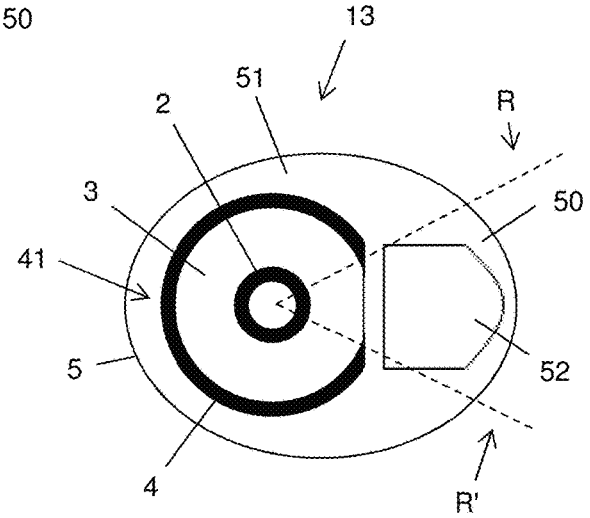

In order to further increase protection of the radiating portion 40, according to a variant of the second embodiment the first jacket portion 50 facing the radiating portion 40 of the shield 4 comprises a cavity 52 longitudinally extending along at least one length of the cable, as in the cable 13 depicted in FIG. 3*b*. This is applicable both in case of eccentric jacket arrangement and in case of concentric jacket arrangement.

As described above in connection with the first embodiment, also in the radiating coaxial cable 13 according to such variant of the second embodiment the shape and size of the cross section of the cavity 52 may be chosen, on the one hand, so as to maximize protection of the radiating portion 40 against interference of metal objects placed near to or in contact with the radiating coaxial cable 13 and, on the other hand, to preserve the mechanical solidity of the cable 13 by preventing the first jacket portion 50 from collapsing when the cable 13 is bent or subjected to mechanical stresses. The shape and size of the cavity 52 as depicted in FIG. 3*b* is purely exemplary.

Also, according to the second embodiment, the cavity 52 may be either empty (namely, filled with air) or at least partially filled with a suitable material, as discussed above.

According to the above described first and second embodiments, the shield 4 of the coaxial cable comprises a single radiating portion 40, namely the cable has one radiating side only. The present invention is however applicable also to coaxial cables having two or more radiating sides.

Figure 4A:
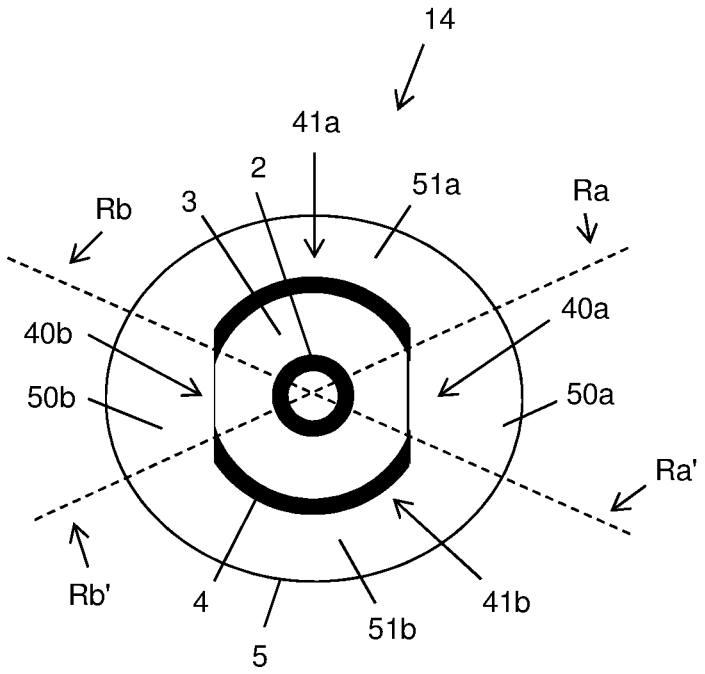
FIGS. 4*a* and 4*b* schematically show a radiating coaxial cable according to a third embodiment of the present disclosure and a variant thereof.
Figure 4B:
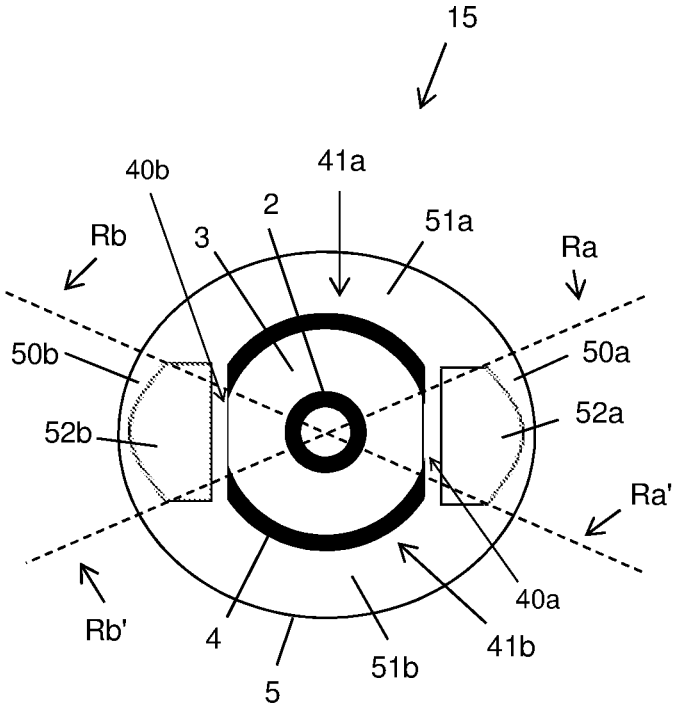

FIG. 4*a* shows a cross-sectional view of a coaxial cable 14 according to a third embodiment of the present invention, whose shield 4 comprises two diametrically opposed radiating portions 40*a*, 40*b* longitudinally extending along the cable length. Each radiating portion 40*a*, 40*b* has a respective plurality of radiating apertures, as described above. Optionally, the presence of the radiating apertures can impart the radiating portions 40*a*, 40*b* of the shield 4 with a partially flat appearance in cross-section, as depicted in FIGS. 4*a* and 4*b*. Hence, according to the third embodiment, the shield 4 comprises two diametrically opposed non-radiating portions 41*a*, 41*b* which are complementary to the radiating portions 40*a*, 40*b* and have no radiating apertures. The radiating portions 40*a*, 40*b* can have different size one respect to the other.

Also, according to the third embodiment, the jacket 5 has a non-uniform thickness. In particular, the first jacket portions 50*a*, 50*b* facing the radiating portions 40*a*, 40*b* of the shield 4 are thicker than the remainder of the jacket 5, namely the second jacket portions 51*a*, 51*b* which are complementary to the jacket portions 50*a*, 50*b* and face the non-radiating portions 41*a*, 41*b* of the shield 4.

As depicted in FIG. 4*a*, the first jacket portion 50*a* (50*b*) facing the radiating portion 40*a* (40*b*) of the shield 4 is the jacket portion enclosed between, two rays Ra (Rb) and Ra' (Rb') originating in the center of the shield 4 and intersecting the opposite edges of the radiating apertures of the radiating portion 40*a* (40*b*) of the shield 4. The above definitions of "thicker" and "thickness" still apply.

Also, according to the third embodiment, the jacket 5 may have a cross section with an oval or elliptical outer contour and a substantially circular inner contour (excepting for one or more flat portions contacting the aperture/s 42 of the radiating portions 40*a*, 40*b* of the shield 4), as depicted in FIG. 4*a*. According to the third embodiment, the jacket 5 is shaped so that the center of its cross section outer contour is substantially coincident with the center of the shield 4 (concentric arrangement). Other shapes of the jacket cross-section could be envisaged, provided the first jacket portions 50*a*, 50*b* facing the radiating portions 40*a*, 40*b* of the shield 4 are thicker than the second jacket portions 51*a*, 51*b* which face the non-radiating portions 41*a*, 41*b* of the shield 4.

In order to further increase protection of the radiating portions 40*a*, 40*b* against interference of metal objects placed near to or in contact with the radiating sides of the coaxial cable, according to a variant of the third embodiment at least one of the first jacket portions 50*a*, 50*b* facing the radiating portions 40*a*, 40*b* of the shield 4 comprises a cavity 52*a*, 52*b* longitudinally extending along at least one length of the cable, as in the cable 15 depicted in FIG. 4*b*.

As described above in connection with first and second embodiments, also in the radiating coaxial cable 15 according to such variant of the third embodiment the shape and size of the cross section of the cavities 52*a*, 52*b* may be chosen, on the one hand, so as to maximize protection of the radiating portions 40*a*, 40*b* of the shield 4 against interference of metal objects placed near to or in contact with the radiating coaxial cable 15 and, on the other hand, to preserve the mechanical solidity of the cable 15 by preventing the first jacket portions 50*a*, 50*b* from collapsing when the cable 15 is bent or subjected to mechanical stresses. The shape and size of the cavities 52*a*, 52*b* as depicted in FIG. 4*b* is purely exemplary.

Also according to the third embodiment, the cavities 52*a*, 52*b* may be either empty (air) or at least partially filled with a suitable material, as discussed above. If a cavity 52*a*, 52*b* is empty, it may house at least one optical fiber.

In all the embodiments described above, the higher thickness of the first jacket portion(s) facing the radiating shield portion(s) advantageously increases the distance from the radiating shield portion of any object external to the cable, e.g. a metal object such as a metal clamp, which is brought in contact with the outer surface of the radiating coaxial cable on its radiating side.

Figure 6A:
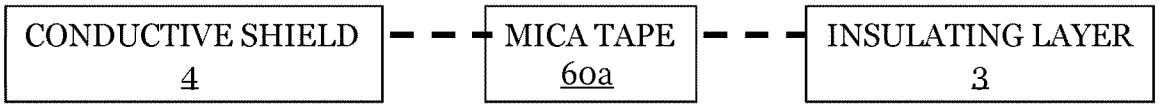
FIGS. 6*a* and 6*b* schematically illustrate further details of the radiating coaxial cable.
Figure 6B:
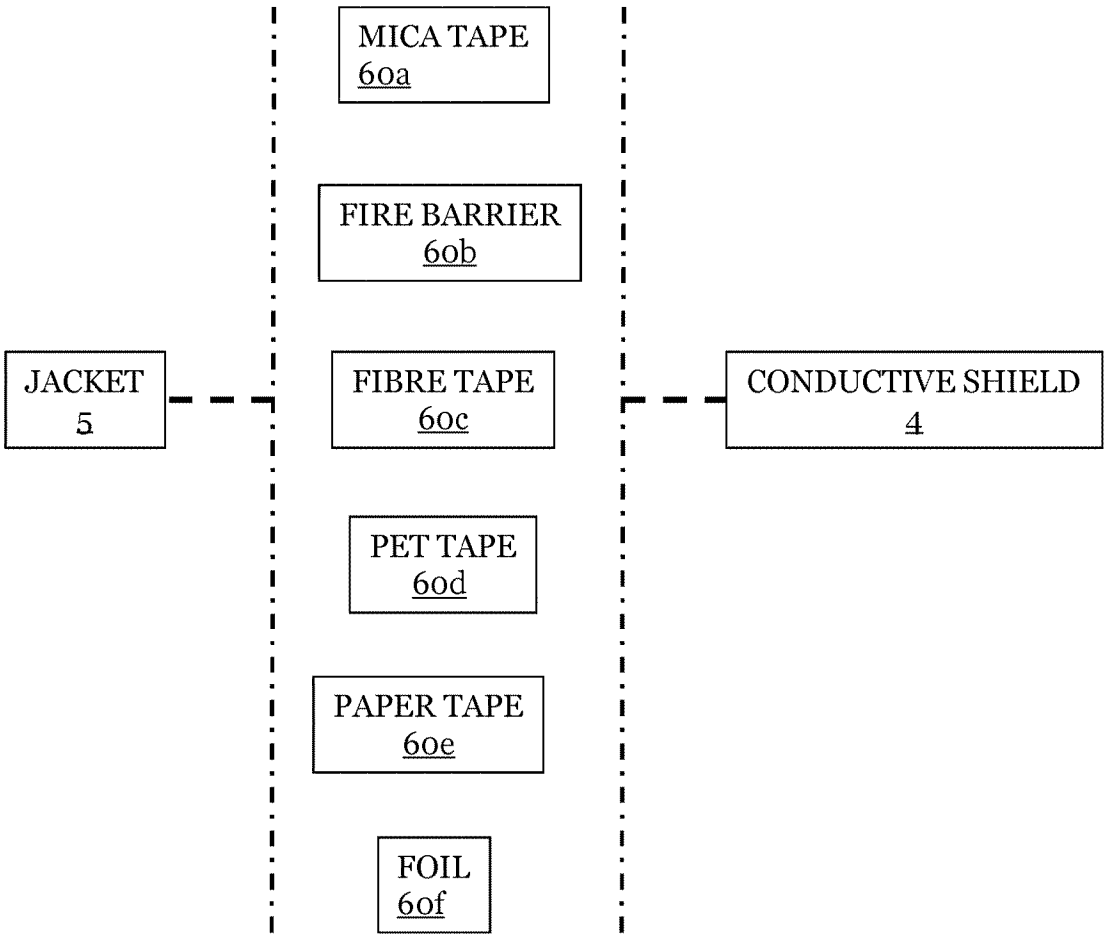

FIGS. 6*a* and 6*b* schematically illustrate further details of the radiating coaxial cable. In FIG. 6*a*, a mica tape 60*a* is interposed between the conductive shield 4 and the insulating layer 3. In FIG. 6*b*, a mica tape 60*a* or other fire barrier 60*b*, a fibre tape 60*c*, a PET tape 60*d* or a paper tape 60*e* or foil 60*f* is interposed between the jacket 5 and the conductive shield 4.

Figure 5A:
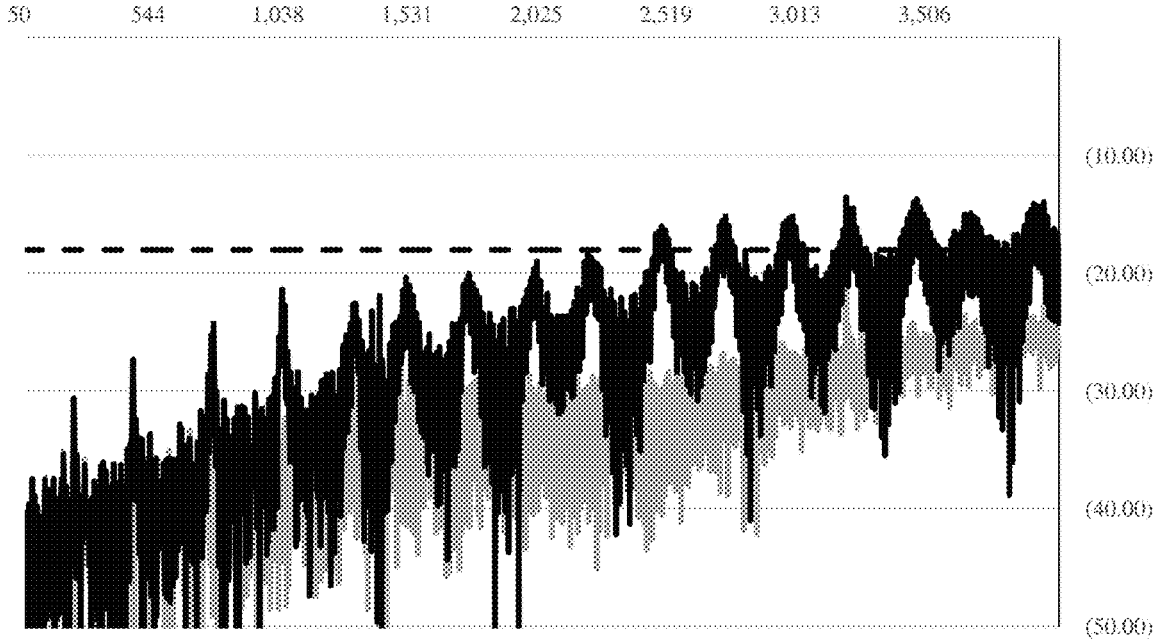
FIGS. 5*a* and 5*b* are, respectively, return loss vs frequency and attenuation vs frequency graphs showing the results of tests made by the Applicant.
Figure 5B:
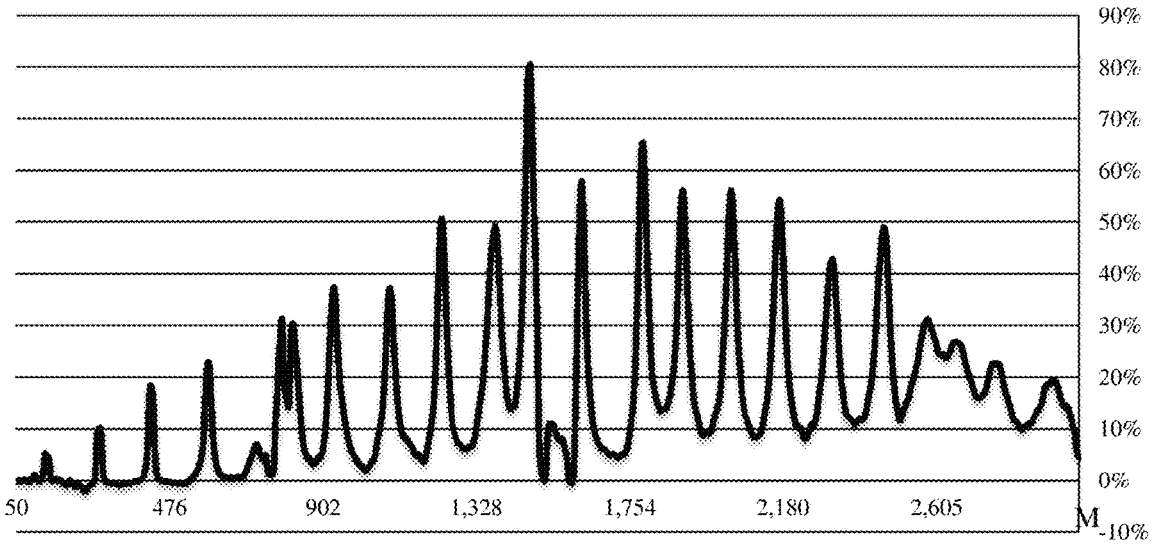

The Applicant has made some tests, whose results are shown in FIGS. 5*a* and 5*b* wherein, respectively, the return loss and the attenuation values are shown in ordinate versus the frequency in abscissa.

Such values have been measured on a 100 m length of straight radiating coaxial cable before and after a metal element is positioned at different distance from the cable.

FIG. 5*a* illustrates the return loss in a cable according to the prior art (i.e. with no thicker jacket in correspondence to the radiating portion). The return loss, in ordinate, is express as -dB, while the frequency, in abscissa, ranges from 50 to 4000 MHz. The peaks in grey refers to a cable having no metal object at a distance shorter than 15 mm, and its peak heights remain below the maximum threshold of −18 dB over the whole operative frequency range. The peaks in black refers to a cable having a metal object (50 cm long) at a distance of about 5 mm from the cable jacket. The increase of return losses is apparent and, in particular, the presence of the metal object makes the use of the cable not viable in the frequency band of about 2200-4000 MHz. In the case, not shown, where the 50 cm long metal object was in direct contact with the cable jacket, the use of the cable was found not viable in the frequency band of about 1000-4000 MHz.

FIG. 5*b* illustrates the attenuation in a cable according to the prior art (i.e. with no thicker jacket in correspondence to the radiating portion). In ordinate, the graph shows the percent of attenuation increase in a cable with a metal object (915 mm long) in the vicinity (4 mm) with respect to the attenuation in a cable having no metal object at a distance more near than 15 mm. In abscissa, the frequency ranges from 50 to 4000 MHz. The percentage of attenuation increase is more than 30% in the majority of frequency band (from about 800 to about 2600 MHz). The return losses were measured for this cable too (not illustrated), and the use of this cable (having a metal object 915 mm long at 4 mm from the cable jacket) was found not viable in the frequency band of about 1200-3000 MHz.

According to the above described embodiments of the present disclosure, the above return loss and attenuation reduction is achieved by increasing the thickness of the jacket portion on the radiating side(s) of the cable, namely the jacket portion facing the apertures in the cable shield.

Hence, when the cable according to any of the above described embodiments of the present disclosure is installed by using (also) metal clamps which, in order to firmly hold the cable, are shaped so as to surround and be in contact with the jacket of the radiating coaxial cable, the disturbing effect of the metal clamps in terms of return loss is advantageously reduced, since the metal clamps are kept at an increased distance from the radiating portion of the shield.

The installation spacing of fire-resistant metal clamps may then be reduced from 8-10 m to 2-3 meters, thereby allowing to avoid use of plastic clamps. Use of a single type of clamps (metal clamps) advantageously results in easier installation of the cable and reduced installation costs.

What is claimed is:

1. A radiating coaxial cable comprising:

an inner conductor;

an insulating layer surrounding and directly contacting the inner conductor;

a conductive shield surrounding the insulating layer and comprising a radiating longitudinal shield portion and a non-radiating longitudinal shield portion;

a plurality of radiating apertures disposed in the radiating longitudinal shield portion, the non-radiating longitudinal shield portion being free from any radiating apertures; and a jacket surrounding the conductive shield and comprising a first jacket portion facing the radiating longitudinal shield portion and a second jacket portion facing the non-radiating longitudinal shield portion, wherein the first jacket portion is thicker than the second jacket portion, wherein a center of a cross section of the jacket is offset from a center of a cross section of the conductive shield to define the first jacket portion facing the radiating longitudinal shield portion to be thicker than the second jacket portion facing the non-radiating longitudinal shield portion.

2. A radiating coaxial cable comprising:

an inner conductor;

an insulating layer surrounding and directly contacting the inner conductor;

a conductive shield surrounding the insulating layer and comprising a radiating longitudinal shield portion and a non-radiating longitudinal shield portion;

a plurality of radiating apertures disposed in the radiating longitudinal shield portion, the non-radiating longitudinal shield portion being free from any radiating apertures; and a jacket surrounding the conductive shield and comprising a first jacket portion facing the radiating longitudinal shield portion and a second jacket portion facing the non-radiating longitudinal shield portion, wherein the first jacket portion is thicker than the second jacket portion, wherein a center of a cross section of the jacket is offset from a center of a cross section of the conductive shield to define the first jacket portion facing the radiating longitudinal shield portion to be thicker than the second jacket portion facing the non-radiating longitudinal shield portion, wherein the jacket has a cross section having a substantially circular inner contour and a substantially elliptical outer contour.

3. A radiating coaxial cable comprising:

an inner conductor;

an insulating layer surrounding and directly contacting the inner conductor;

a conductive shield surrounding the insulating layer and comprising a radiating longitudinal shield portion and a non-radiating longitudinal shield portion;

a plurality of radiating apertures disposed in the radiating longitudinal shield portion, the non-radiating longitudinal shield portion being free from any radiating apertures; and a jacket surrounding the conductive shield and comprising a first jacket portion facing the radiating longitudinal shield portion and a second jacket portion facing the non-radiating longitudinal shield portion, wherein the first jacket portion is thicker than the second jacket portion, wherein a center of a cross section of the jacket is offset from a center of a cross section of the conductive shield to define the first jacket portion facing the radiating longitudinal shield portion to be thicker than the second jacket portion facing the non-radiating longitudinal shield portion, wherein the first jacket portion comprises a cavity longitudinally extending along a length of the radiating coaxial cable.

4. The radiating coaxial cable according to claim 3, wherein the cavity houses an optical fiber.

5. The radiating coaxial cable according to claim 3, wherein the cavity is empty.

6. The radiating coaxial cable according to claim 3, wherein the cavity is partially filled with filling material.

7. The radiating coaxial cable according to claim 3, wherein the cavity is completely filled with filling material.

* * * * *